United States Patent [19]

Tararuj

[11] Patent Number: 4,923,063

[45] Date of Patent: May 8, 1990

[54] SAMPLE PACKET FOR CREAMS AND METHOD OF MANUFACTURE

[75] Inventor: Christopher Tararuj, Trenton, N.J.

[73] Assignee: Webcraft Technologies, Inc., No. Brunswick, N.J.

[21] Appl. No.: 266,650

[22] Filed: Nov. 3, 1988

[51] Int. Cl.[5] ..... B65D 73/00

[52] U.S. Cl. ..... 206/484; 26/467

[58] Field of Search ..... 206/469, 484, 467

[56] References Cited

U.S. PATENT DOCUMENTS

| | | | |
|---|---|---|---|
| 4,506,789 | 3/1985 | Dlugosz | 206/469 |
| 4,781,294 | 11/1988 | Croce | 206/469 |
| 4,787,160 | 11/1988 | Balsamo | 206/469 |

*Primary Examiner*—Joseph Man-Fu Moy

*Attorney, Agent, or Firm*—Shlesinger & Myers

[57] ABSTRACT

A sample packet for creams and the like comprises a sheet having a coating for preventing absorption of a cream and further including a score line for defining first and second panels. A continuous line of adhesive is applied to one of the panels. The second panel is folded into overlying relation with the first panel and is secured thereto by the adhesive, the panels cooperate with the adhesive for defining a reservoir. The second panel includes a frangible pull tab overlying the reservoir, the frangible pull tab adapted for being severed from the second panel for thereby causing the reservoir to be opened.

24 Claims, 2 Drawing Sheets

SAMPLE PACKET FOR CREAMS AND METHOD OF MANUFACTURE

BACKGROUND OF THE INVENTION

The manufactures and distributors of flowable cosmetics, such as hand creams, lotions and the like, have found that sales of the product are increased by first permitting the consumer to use a sample thereof. In the past, such samples have normally been available at retail outlets through the provision of a sample bottle which must be replaced when empty. Further samples have been provided through single use foil packages which have been distributed door to door. Such distribution is, however, relatively expensive, with the result that the audience must be carefully targeted.

Other cosmetics, such as lipsticks, blushes and like powdery cosmetic compositions, have recently been packaged for sample distribution within magazines and like publications. In this regard, a sample packet is bound into the magazine for being distributed with same. Magazine distribution does present the problem, however, that the packaging system and/or cosmetic composition must have sufficient structural integrity to withstand the pressures and impacts exerted during the manufacture and distribution of the magazines. It is not unusual for in excess of 100 magazines to be oriented in a stack, with the result that the cosmetic package at the bottom must have sufficient integrity to prevent the cosmetic composition from being damaged and/or the package destroyed or otherwise rendered unacceptable for distribution to the consumer.

Highly viscous cosmetic compositions, such as creams, lotions and the like, have not generally been suitable for distribution within magazines. Such compositions normally are oil-based, with the result that the package must have some mechanism for preventing absorption of the oil into the packaging, as well as into the surrounding magazine. Also, normal sample packets contain a relatively large volume of material, with the result that they are bulky, thereby altering the flat magazine so as not to be suitable for magazine distribution. The large volume furthermore makes it difficult to construct a packaging which can withstand the weight of the magazine stack. Finally, it is normally preferred that the packaging contain advertising copy extolling the benefits of the cosmetic, with the result that this has previously required separate handling or a fiberboard stock to which the packet could be attached.

Those skilled in the art can appreciate, therefore, that there is a need for a sample packet for highly viscous flowable cosmetics which is suitable for distribution in magazines and the like. The packet must provide sufficient cosmetic composition for the consumer, but should not contain so much as to require a bulky package or one not otherwise suitable for insertion into a magazine. The packet should furthermore be capable of relatively inexpensive manufacture in order to permit wide dissemination, while also not requiring a separate vehicle for the advertising copy.

The disclosed invention provides just such a sample packet for cosmetic creams and the like. The disclosed sample packet can be manufactured from conventional paper webs which are appropriately coated to withstand absorption of the oils. The sample packet may be manufactured in line with an offset or similar printing press, and the advertising copy may be printed directly onto the paper substrate.

OBJECTS OF THE INVENTION

The primary object of the disclosed invention is a sample packet, for highly viscous flowable cosmetic compositions, which may be manufactured in line on an offset or similar printing press utilizing a paper substrate which has been coated with an appropriate polymeric coating.

A further object of the disclosed invention is a method of manufacturing a sample packet, for highly viscous flowable cosmetic compositions, which is relatively inexpensive and permits the sample packet to have advertising copy applied directly thereto.

A sample packet for creams and the like according to the invention comprises a sheet including means incorporated therewith for preventing absorption of a cream and further including means for defining first and second panels. A continuous line of adhesive means is applied to one of the panels. The second panel is folded into overlying relation with the first panel and is secured thereto by the adhesive means, and the panels cooperate with the adhesive means for defining a reservoir. The second panel includes frangible opening means overlying the reservoir, and the frangible opening means are adapted for being severed from the second panel so that the reservoir may be opened.

A sample packet for highly viscous cosmetics comprises a first sheet including means for preventing absorption of a high viscosity flowable cosmetic composition. A first line of first adhesive means is applied to the first sheet, and the first line has spaced terminal ends and is continuous between the ends. A second continuous line of second adhesive means is applied to the first sheet and interconnects the ends of the first line. A second sheet includes means for preventing absorption of a high viscosity flowable cosmetic composition and overlies the first sheet and is secured thereto by the first and second adhesive means. The first and second adhesive means cooperate with the first and second sheets for defining therebetween a reservoir. The second sheet includes frangible opening means overlying the reservoir and secured to the first sheet by the second adhesive means. The tensile strength of the bond between the sheets provided by the second adhesive means is less than the tensile strength of the bond provided by the first adhesive means so that the frangible opening means may be severed from the second sheet for thereby causing the reservoir to be opened.

The method of manufacturing a sample packet for cosmetic creams and the like comprises the steps of providing a sheet having incorporated therewith means for preventing the absorption of a cream and further including a first portion having means defining a frangible tab. A bounded area is defined on a second portion of the sheet by applying thereto a continuous line of adhesive means. A selected quantity of a cosmetic cream is deposited onto the sheet in the bounded area. The first portion is folded into overlying relation with the second portion so that the frangible tab overlies the bounded area, with the result that the second portion is secured to the first portion by the adhesive means.

These and other objects and advantages of the invention will be readily apparent in view of the following description and drawings of the above described invention.

DESCRIPTION OF THE DRAWINGS

The above and other objects and advantages and novel features of the present invention will become apparent from the following detailed description of the preferred embodiment of the invention illustrated in the accompanying drawings, wherein.

DESCRIPTION OF THE INVENTION

Figure 1:
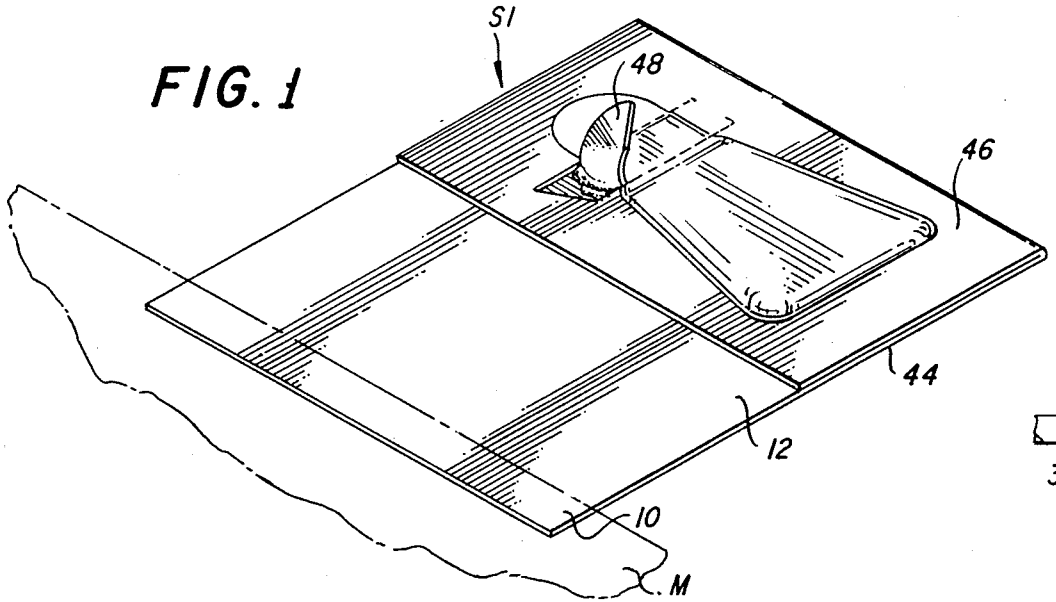
FIG. 1 is a perspective view with portions shown in phantom of the sample packet of the invention bound into a magazine.

Sample packet S1, as best shown in FIG. 1, is bound into the binding of magazine M through utilization of conventional binding techniques. The packet S1 has a bindin portion 10 integral with panel 12. The panel 12 preferably contains advertising copy explanatory of the cosmetic being distributed within the packet S1. The packet S1 may be encased in a suitable transparent enclosure if desired.

Figure 5:
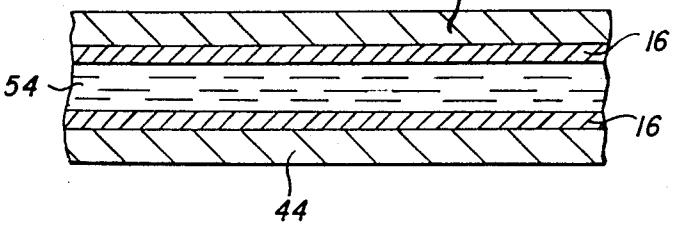
FIG. 5 is a fragmentary cross-sectional view through the packet of FIG. 2.
Figure 8:
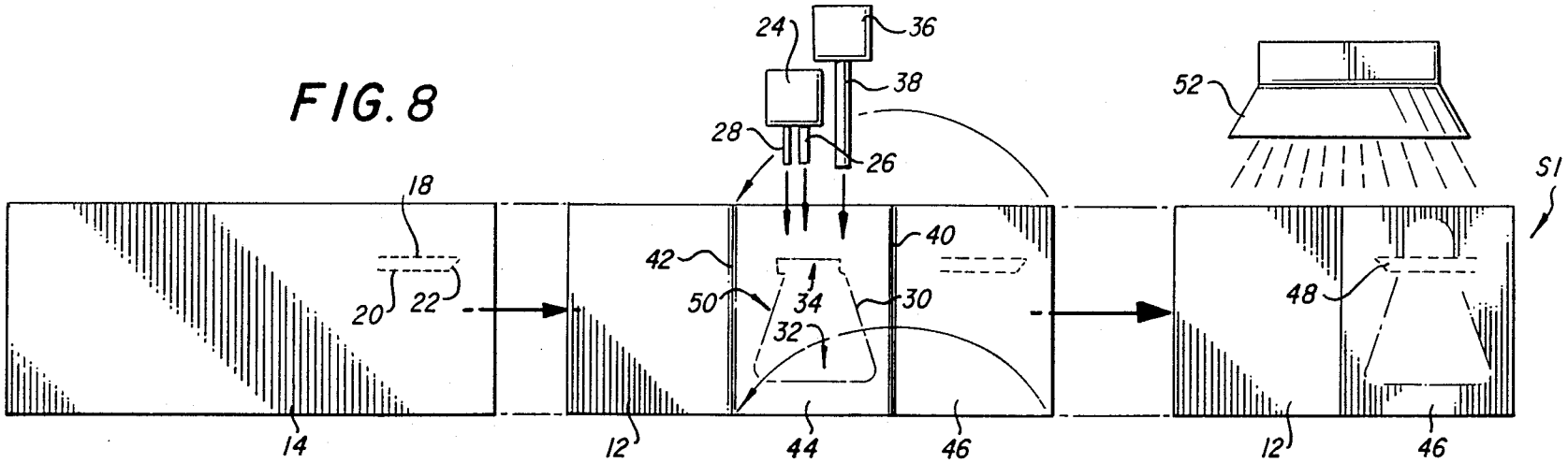

The sample packet S1 of FIG. 1 is formed from a paper substrate or web 14, as best shown in FIG. 8, which has applied thereto a suitable polymeric coating 16, as best shown in FIG. 5. The polymeric coating is preferably cellulosic rather than a foil, and may be selected from any one of carboxymethylcellulose, polyvinyl alcohol, polyvinylpyrrolidone, polyvinylidene chloride or other suitable polymeric combinations. The polymeric coating prevents oil absorption by the web 14, as well as subsequent staining or leakage of the cosmetic composition onto the adjoining pages of the sampler or the magazine M. Naturally, the coating 16 is relatively thin, and may be coated on the paper in any suitable manner. Foils and plastics are not suitable because of cost, thickness and relative difficulty in printing.

As illustrated in FIG. 8, the web 14 is rectangular in plan, and has a length dimension exceeding the width dimension. A first portion of the web 14 has perforation lines 18 and 20 interconnected by slit 22. The perforation lines 18 and 20 and slit 22 are, preferably, formed by conventional die cutting techniques and no further explanation thereof is believed necessary. Furthermore, while I have disclosed perforation lines 18 and 20, those skilled in the art will appreciate that these need not be formed of perforations extending through web 14, but merely need be lines of weakening.

The web 14 is next advanced to adhesive applicator 24, which has adhesive nozzles 26 and 28. Naturally, the adhesive applicator 24 has appropriate displacement mechanisms in order to permit a continuous line of adhesive 30 suitable to be applied to an adjacent second portion of web 14. Other methods of applying said adhesives may be utilized as is known in the art. It can be seen in FIG. 8 that the adhesive line 30 has a configuration resembling a bottle, including a relatively wide base portion 32 and a relatively narrow spout portion 34. Furthermore, the line of adhesive 30 is spaced from the lines of perforations 18 and 20 and slit 22. While I disclose a single adhesive line 30, this could also be provided by adhesive substantially covering the relevant portions of web 14, except for certain defined areas.

Cosmetic applicator 36, having nozzle 38, deposits a quantity of a highly viscous flowable cosmetic composition, such as a hand cream, lotion or the like, within the bounded area defined by the adhesive line 30. As used herein, the term "highly viscous flowable cosmetic composition" is meant to include those cosmetic compositions having the consistency at ambient temperatures of creams or lotions, usually oil-based, as opposed to solid lipsticks which are highly viscous but not flowable at ambient temperatures. Likewise, it is not meant to include solid compositions such as powders, rouges and the like, and is also not meant to include encapsulated perfumes and fragrances which have been distributed through magazine inserts.

Score lines 40 and 42 are formed by conventional means in the web 14 on opposite sides of the adhesive line 30, and thereby divide the web into panels 12, 44 and 46. The panels 44 and 46 preferably have uniform dimensions in order to permit the panel 46 to overlie the panel 44, and panel 12 may be folded over panel 46 for distribution in magazines or as is desired.

The panel 46 is folded into overlying relation relative to the panel 44 and is secured thereto by the line of adhesive 30. It can be noted that the lines of perforations 18 and 20 and the slit 22 likewise overlie the bounded area defined by the line of adhesive 30, so that the perforations 18 and 20 and slit 22 define a pull tab 48 at one end thereof permitting the reservoir 50 to be opened. The reservoir 50 is defined by the cooperative action of the line of adhesive 30 with the panels 46 and 44. The adhesive line 30 does have some height, with the result that the reservoir 50 has a selected volume for containing a cosmetic composition.

Depending upon the adhesive chosen for the line 30, then the sample packet S1 may be cured by curing medium 52, which perferably includes a drying oven, infrared heating lamp or the like. Once the sample packet S1 has been appropriately cured, then it may be sent for being bound into the magazine M.

Figure 2:
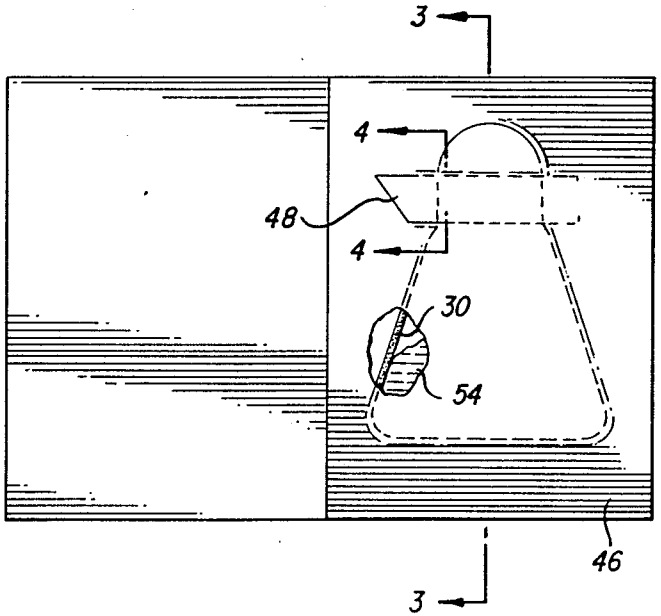
FIG. 2 is a top plan view of the sample packet of FIG. 1 with portions broken away.

As best shown in FIG. 2, cosmetic composition 54 does not fill the entire volume of the reservoir 50. I have found that best results are obtained when the quantity of cosmetic composition 54 does not completely fill the reservoir 50, because the pressure exerted by the magazine stack can be sufficiently high to cause the cosmetic composition 54 to leak through the lines of perforations 18 and 20. In this regard, a reservoir having an area of approximately one square inch should normally contain no more than about 20 milligrams of cosmetic composition 54 in order to avoid the need for sealing the perforation lines 18 and 20.

Figure 3:
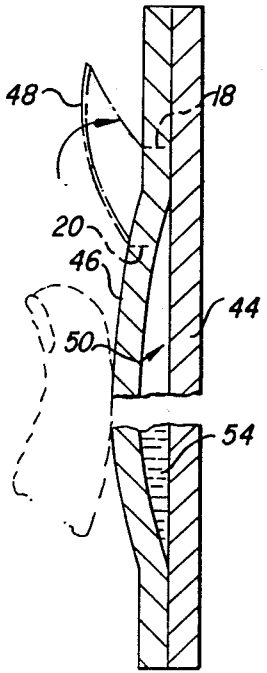
FIG. 3 is a cross-sectional view taken along the line 3—3 of FIG. 2 and viewed in the direction of the arrows.
Figure 4:
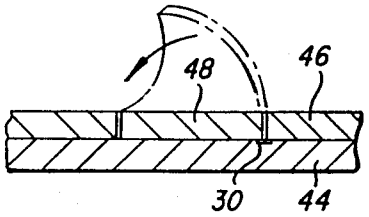
FIG. 4 is a fragmentary cross-sectional view taken along the line 4—4 of FIG. 2.

FIG. 3 discloses the sampler packet S1 in the condition where the cream 54 is ready to be removed for sampling by the consumer. It can be noted in FIG. 3 that the cosmetic composition 54 only fills a portion of the reservoir 50, with the result that there is substantial room for the cream 54 to spread out in during manufacture and shipment of the magazine M. Once the pull tab 48 has been severed from the panel 46 by tearing of the perforations of the perforation lines 18 and 20, then the cream 54 may be removed from the reservoir 50 through the application of pressure, such as by a finger. The pull tab 48 has a suitable portion disposed beyond glue line 30 and not otherwise bound to panel 44 in order to facilitate opening of the reservoir 50. Because tab 48 is not bound to panel 44, it may be readily lifted.

Figure 6:
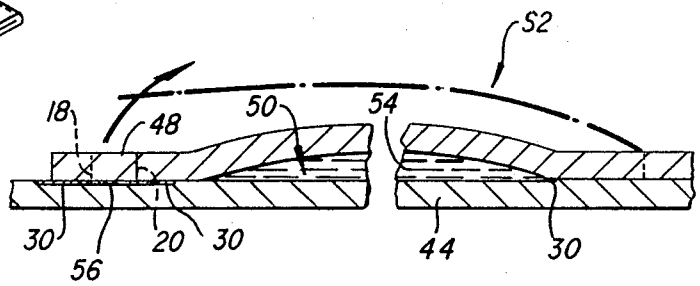
FIG. 6 is a cross-sectional view of a second embodiment of the invention with broken lines indicating indeterminate length.

FIG. 6 discloses an embodiment of the invention wherein the reservoir 50 is nearly completely filled with cosmetic composition 54. In that event, I provide a layer of a resealable pressure sensitive adhesive or like tack or fugitive adhesive 56 underlying the area between perforation lines 18 and 20. This further layer of adhesive 56 more tightly secures the body of pull tab 48 between the perforation lines 18 and 20 to the underlying layer 44, because it extends substantially the length and width thereof. Consequently, the application of pressure to the panel 46 is not sufficient to cause the cosmetic composition 54 to leak through the perforations of the lines of perforations 18 and 20. The sampler S2 of FIG. 6 utilizes a permanent glue, or permanent pressure sensitive adhesive for the glue line 30. The glue line 30, in the embodiment S2 of FIG. 6, therefore has a gap between the terminal ends thereof, which ends are interconnected by the continuous line of adhesive 56.

I prefer that the permanent adhesive 30 be selected from the group consisting of white glues, vinyl acetate or similar permanent adhesives in order to provide a bond of high tensile strength between panels 44 and 46. The adhesive 56, on the other hand, should be selected from the group consisting of pressure sensitive fugitive adhesives, and polyethylene wax emulsions both with and without acrylic adhesives in order to provide a bond between panels 44 and 46 having a tensile strength less than that provided by adhesive 30 and less than the tensile strength of the paper pull tab 48. Those skilled in the art will appreciate, however, that there are other permanent, resealable or fugitive adhesives which can be used in practice of the invention, depending upon the application. The use of adhesives 30 and 56 avoids the need for sonic or heat sealing and the like which is generally a slower process.

Figure 7:
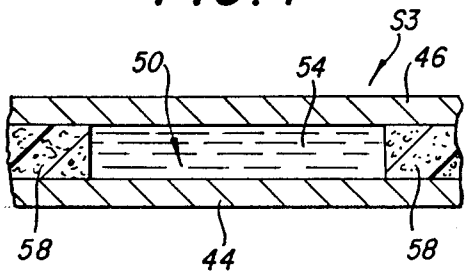
FIG. 7 is a fragmentary cross-sectional view of a third embodiment of the invention; and, FIG. 8 is a schematic view illustrating the process for manufacturing the sample packet of FIG. 1.

FIG. 7 illustrates a sample packet S3 which is similar to the packets S1 and S2. The packet S3 utilizes an expanding foamable adhesive, such as FOAM-COAT TM, place of the adhesive 30. The reservoir 50 is defined by a continuous line of foam 58 which is expansible. The foam 58 secures the juxtaposed panels 44 and 46, and has the further advantage of providing a reservoir 50 of greater volume than is provided for by the adhesive 30.

The disclosed invention provides a customer ready, single use sample which is copy ready for insertion into a magazine or other like means of mass circulation. The product sample area and other format aspects provide a great deal of flexibility in terms of size, shape, and overall adaptability to any finished piece specifications.

While this invention has been described as having a preferred design, it is understood that it is capable of further modifications, uses, and/or adaptations of the invention following in general the principle of the invention and including such departures from the present disclosure as come within known or customary practice in the art to which the invention pertains, and as may be applied to the central features hereinbefore set forth, and fall within the scope of the invention of the limits of the appended claims.

What I claim is:

1. A sample packet for creams and the like, comprising:

(a) a paper sheet including means incorporated therewith for preventing absorption of a cream and further including means for defining first and second panels;

(b) a continuous line of adhesive means applied to one of said panels;

(c) said second panel folded into overlying relation with said first panel and being secured thereto by said adhesive means, said panels cooperate with said adhesive means for defining a reservoir; and, (d) said second panel includes frangible opening means overlying said reservoir, said frangible opening means adapted for being severed from said second panel for thereby causing said reservoir to be opened.

2. The packet of claim 1, wherein:

(a) said sheet is has an oil impervious coating applied thereto.

3. The packet of claim 2, wherein:

(a) said defining means includes a score line; and, (b) said panels have common dimensions and said second panel is folded along said score line.

4. The packet of claim 2, wherein:

(a) said oil impervious coating is selected from the group consisting of carboxymethylcellulose, polyvinyl alcohol, polyvinylpyrrolidone, polyvinylidene chloride as well as other suitable polymers and combinations thereof.

5. The packet of claim 2, wherein:

(a) said adhesive means is selected from the group consisting of permanent glue, resealable pressure sensitive adhesives, permanent pressure sensitive adhesives, fugitive adhesives, and foamable adhesives.

6. The packet of claim 2, wherein:

(a) said first panel is substantially larger than said second panel and includes a bind-in portion adapted for being bound into a publication.

7. The packet of claim 1, wherein:

(a) said adhesive means comprises first and second adhesives, said first adhesive has spaced first and second terminal ends and said second adhesive interconnects said ends; and, (b) said frangible opening means has a first end portion secured by said first adhesive means, a body portion secured by said second adhesive means, and a second end portion not secured to said first panel.

8. The packet of claim 7, wherein:

(a) the tensile strength of the bond between said panels provided by said first adhesive means exceeds the tensile strength provided by said second adhesive means.

9. The packet of claim 7, wherein:

(a) said first adhesive is selected from the group consisting of permanent glue, permanent pressure sensitive adhesives and foamable adhesives, and said second adhesive is selected from the group consisting of resealable pressure sensitive adhesives and fugitive tack adhesives.

10. The packet of claim 1, wherein:

(a) said frangible opening means is comprised of a pair of spaced parallel lines of perforations defining a severable body portion having opposite portions thereof secured by said adhesive means to said first panel.

11. The packet of claim 10, wherein:

(a) a slit in said second panel extends between said lines of perforations at one end thereof for defining a tab portion not secured to said first panel for facilitating grasping of said tab portion.

12. The packet of claim 1, further comprising:

(a) a selected quantity of a high viscosity flowable cosmetic material is disposed within said reservoir.

13. The packet of claim 12, wherein:

(a) the volume of said high viscosity flowable cosmetic material is substantially less than the volume of said reservoir so that application of pressure to said reservoir is insufficient to cause said high viscosity material to leak through said frangible opening means.

14. A sample packet for high viscosity cosmetics, comprising:

(a) a first sheet including means for preventing absorption of a high viscosity flowable cosmetic composition;

(b) a first line of first adhesive means applied to said first sheet, said first line has spaced terminal ends and is continuous between said ends;

(c) a second continuous line of second adhesive means is applied to said first sheet and interconnects said ends;

(d) a second sheet including means for preventing absorption of a high viscosity flowable cosmetic composition overlies said first sheet and is secured thereto by said first and second adhesive means, said first and second adhesive means cooperate with said first and second sheets for defining therebetween a reservoir; and, (e) said second sheet includes frangible opening means overlying said reservoir and secured to said first sheet by said second adhesive means, the tensile strength of the bond between said sheets provided by said second adhesive means is less than the tensile strength of the bond provided by said first adhesive means so that said frangible opening means may be severed from said second sheet for thereby causing said reservoir to be opened.

15. The packet of claim 14, wherein:

(a) said first and second sheets are comprised of paper; and, (b) said preventing means includes a polymeric composition.

16. The packet of claim 15, wherein:

(a) said polymeric composition is selected from the group consisting of carboxymethylcellulose, polyvinyl alcohol, polyvinylpyrrolidone, and polyvinylidene chloride.

17. The packet of claim 14, wherein:

(a) said first adhesive means is selected from the group consisting of permanent glue, permanent pressure sensitive adhesive and foamable adhesive; and, (b) said second adhesive means is selected from the group consisting of tack adhesive and resealable pressure sensitive adhesive.

18. The packet of claim 15, wherein:

(a) said sheets are integral and defined by a score line;

(b) said second sheet is folded about said scoreline into said overlying relation; and, (c) said first sheet includes a bind-in portion for being bound into a publication.

19. The method of manufacturing a sample packet for cosmetic creams and the like, comprising the steps of:

(a) providing a paper sheet having incorporated therewith means for preventing the absorption of a cream and further including a first portion having means defining a frangible tab;

(b) defining a bounded area on a second portion of said sheet by applying a continuous line of adhesive means thereto;

(c) depositing a selected quantity of a cosmetic cream onto the sheet in the bounded area; and, (d) folding the first portion into overlying relation with the second portion so that the frangible tab overlies the bounded area and thereby causing the second portion to be secured to the first portion by the adhesive means.

20. The method of claim 19, including the step of:

(a) providing a paper sheet having incorporated therewith a polymeric composition for preventing absorption of the cream.

21. The method of claim 20, including the step of:

(a) providing a sheet having a polymeric composition applied thereto as a coating.

22. The method of claim 21, including the step of:

(a) selecting the polymeric composition from the group consisting of carboxymethylcellulose, polyvinyl alcohol, polyvinylpyrrolidone, and polyvinylidene chloride.

23. The method of claim 20, including the step of:

(a) selecting the adhesive means from the group consisting of permanent glue, resealable pressure sensitive adhesive, permanent pressure sensitive adhesive, tack adhesive and foamable sealant.

24. The method of claim 23, including the step of:

(a) defining the bounded area by applying two adhesives to the sheet, the first adhesive selected from the group consisting of permanent glue and permanent pressure sensitive adhesive and the second adhesive selected from the group consisting of tack adhesive and resealable pressure sensitive adhesive and the second adhesive underlies the frangible tab.

* * * * *